US009150328B2

(12) United States Patent
Dunn et al.

(10) Patent No.: US 9,150,328 B2
(45) Date of Patent: Oct. 6, 2015

(54) CONTAINER ASSEMBLY HAVING A HEAT-SEALED METAL END, A METAL END THEREFOR, AND A METHOD FOR MAKING SAME

(75) Inventors: Dave Dunn, Carrollton, OH (US); John Meeks, Massillon, OH (US); Jeremy Morin, Canal Fulton, OH (US); Trevor Price, North Canton, OH (US)

(73) Assignee: Sonoco Development, Inc., Hartsville, SC (US)

( * ) Notice: Subject to any disclaimer, the term of this patent is extended or adjusted under 35 U.S.C. 154(b) by 945 days.

(21) Appl. No.: 12/607,731

(22) Filed: Oct. 28, 2009

(65) Prior Publication Data

US 2011/0095030 A1 Apr. 28, 2011

(51) Int. Cl.
*B65D 8/00* (2006.01)
*B65D 21/02* (2006.01)

(52) U.S. Cl.
CPC ..... *B65D 15/06* (2013.01); *B65D 15/08* (2013.01); *B65D 21/0222* (2013.01); *Y10T 29/49826* (2015.01)

(58) Field of Classification Search
CPC .. B65D 21/0222; B65D 43/06; B65D 43/065; B65D 15/08; B65D 15/06; B65D 43/0218
USPC ..... 220/359.1, 359.4, 380, 610, 611, 612, 220/617, 619, 623, 353, 621, 620, 260; 215/353; 206/508; 413/1, 2, 4, 5, 6, 7, 413/26; 229/125.17
See application file for complete search history.

(56) References Cited

U.S. PATENT DOCUMENTS

| | | | | |
|---|---|---|---|---|
| 1,552,134 | A * | 9/1925 | Frey | 220/285 |
| 1,876,450 | A * | 9/1932 | Egan et al. | 220/614 |
| 2,237,809 | A | 4/1941 | Bronson | |
| 2,244,341 | A * | 6/1941 | MacLean | 422/37 |
| 2,445,647 | A * | 7/1948 | Thomas | 215/307 |
| 2,899,096 | A * | 8/1959 | Henchert et al. | 220/4.27 |

(Continued)

FOREIGN PATENT DOCUMENTS

| | | |
|---|---|---|
| CH | 669 574 A5 | 3/1989 |
| EP | 0 036 763 A1 | 9/1981 |

(Continued)

OTHER PUBLICATIONS

International Search Report and Written Opinion for International Application No. PCT/US2010/052412, mailed Dec. 28, 2010 (11 sheets).

*Primary Examiner* — Fenn Mathew
*Assistant Examiner* — Chetan Chandra
(74) *Attorney, Agent, or Firm* — Alston & Bird LLP

(57) ABSTRACT

A container assembly includes a container body having a side wall encircling an axis, and a metal end for attachment to an upper edge of the side wall via heat-sealing. The outer peripheral region is shaped prior to application to the container body such that an annular channel is defined between an inner chuck wall and an outer chuck wall of the metal end. The metal end is pushed straight onto the side wall such that the upper edge of the side wall is received into the channel. The surfaces of the side wall and the opposing surfaces of the chuck walls have heat-sealable material thereon. The metal end is heated to melt and fuse the heat-sealable layers, thereby sealing the metal end onto the side wall. The metal end is shaped such that the free edge of the outer chuck wall is not exposed.

15 Claims, 4 Drawing Sheets

(56) References Cited

U.S. PATENT DOCUMENTS

| | | | | | |
|---|---|---|---|---|---|
| 2,901,161 | A | * | 8/1959 | Henchert | 229/125.17 |
| 3,108,710 | A | | 10/1963 | Lange et al. | |
| 3,173,574 | A | * | 3/1965 | Goldsmith | 206/508 |
| 3,206,060 | A | * | 9/1965 | Turner | 220/611 |
| 3,228,552 | A | | 1/1966 | Rutledge | |
| 3,286,867 | A | * | 11/1966 | Mumford | 215/321 |
| 3,306,488 | A | | 2/1967 | Lemelson | |
| 3,315,865 | A | * | 4/1967 | Bracht | 229/5.6 |
| 3,367,533 | A | * | 2/1968 | Baker | 220/614 |
| 3,378,163 | A | * | 4/1968 | Griffith | 220/260 |
| 3,406,891 | A | | 10/1968 | Buchner et al. | |
| 3,424,343 | A | | 1/1969 | Hoeffelman | |
| 3,580,464 | A | | 5/1971 | Griffith | |
| 3,615,033 | A | * | 10/1971 | Podesta | 215/320 |
| 3,620,437 | A | * | 11/1971 | Kulp | 229/404 |
| 3,624,789 | A | * | 11/1971 | Peyser et al. | 206/508 |
| 3,721,365 | A | * | 3/1973 | Saunders | 220/260 |
| 3,773,208 | A | * | 11/1973 | Curry | 220/269 |
| 3,774,560 | A | * | 11/1973 | Hartz | 413/6 |
| 3,958,717 | A | * | 5/1976 | Ellis | 220/268 |
| 4,044,941 | A | | 8/1977 | Knudsen | |
| 4,094,460 | A | * | 6/1978 | Scanga et al. | 229/123.1 |
| 4,252,265 | A | * | 2/1981 | Brundige et al. | 229/5.7 |
| 4,254,886 | A | * | 3/1981 | Van Doren | 220/658 |
| 4,356,926 | A | | 11/1982 | Priestly et al. | |
| 4,363,404 | A | * | 12/1982 | Westphal | 206/508 |
| 4,372,719 | A | | 2/1983 | Supik | |
| 4,376,506 | A | * | 3/1983 | Westphal | 229/5.6 |
| 4,448,345 | A | | 5/1984 | Helms | |
| 4,538,758 | A | * | 9/1985 | Griffith | 229/4.5 |
| 4,597,502 | A | * | 7/1986 | Troughton | 220/561 |
| 4,650,088 | A | | 3/1987 | Hirota et al. | |
| 4,655,359 | A | | 4/1987 | Fairgrieve | |
| 4,692,132 | A | * | 9/1987 | Ikushima et al. | 493/103 |
| 4,754,113 | A | | 6/1988 | Mohr et al. | |
| 4,757,175 | A | | 7/1988 | Mohr et al. | |
| 4,785,992 | A | * | 11/1988 | Goeppner | 229/5.6 |
| 4,853,510 | A | | 8/1989 | Mohr et al. | |
| 4,948,006 | A | | 8/1990 | Okabe et al. | |
| 5,152,418 | A | | 10/1992 | Kroeschell et al. | |
| 5,169,017 | A | * | 12/1992 | Cooper et al. | 220/273 |
| 5,199,593 | A | | 4/1993 | Kita | |
| 5,427,268 | A | | 6/1995 | Downing, Jr. et al. | |
| 5,433,992 | A | | 7/1995 | Galda et al. | |
| 5,971,259 | A | * | 10/1999 | Bacon | 229/5.6 |
| 5,993,593 | A | | 11/1999 | Swartz et al. | |
| 5,996,835 | A | | 12/1999 | Farrington et al. | |
| 6,079,185 | A | | 6/2000 | Palaniappan et al. | |
| 6,082,541 | A | * | 7/2000 | Bewick | 206/508 |
| 6,126,029 | A | * | 10/2000 | Storgaard | 220/271 |
| 6,194,041 | B1 | | 2/2001 | McHenry et al. | |
| 6,253,951 | B1 | * | 7/2001 | Pruckler | 220/733 |
| 6,258,312 | B1 | | 7/2001 | Heyn | |
| 6,362,461 | B1 | | 3/2002 | Wiening et al. | |
| 6,427,862 | B1 | | 8/2002 | Hsu | |
| 6,883,689 | B2 | | 4/2005 | Odet | |
| 7,380,685 | B2 | * | 6/2008 | Simmons et al. | 220/703 |
| 2002/0125249 | A1 | | 9/2002 | Baird-Smith et al. | |
| 2003/0168423 | A1 | | 9/2003 | Williams | |
| 2004/0069790 | A1 | | 4/2004 | Alexander et al. | |
| 2007/0284276 | A1 | * | 12/2007 | Luttik et al. | 206/508 |
| 2008/0050206 | A1 | | 2/2008 | Kwakkel et al. | |

FOREIGN PATENT DOCUMENTS

| | | | |
|---|---|---|---|
| EP | 0 264 946 | A1 | 4/1988 |
| EP | 0 276 472 | A1 | 8/1988 |
| EP | 0 332 725 | A1 | 9/1989 |
| EP | 0 536 137 | B1 | 4/1993 |
| EP | 0 537 753 | A1 | 4/1993 |
| EP | 0 868 371 | B1 | 10/1998 |
| EP | 1 889 673 | A1 | 2/2008 |
| WO | WO 00/06369 | A1 | 2/2000 |

* cited by examiner

CONTAINER ASSEMBLY HAVING A HEAT-SEALED METAL END, A METAL END THEREFOR, AND A METHOD FOR MAKING SAME

BACKGROUND OF THE INVENTION

The present disclosure relates to containers in general, and more particularly to containers that are closed by a metal end seamed onto the container body.

For many years the standard technique for attaching a metal end to a metal container body has been the double-seaming method, in which a curled outer edge of the metal end and a flange formed on the container body are rolled up together to form a hermetic seam. The double-seaming technique essentially entails mechanically locking together the metal end and the container body flange. Double-seaming works well for metal container bodies because the metal is ductile and permanently deformable without compromising the integrity of the seam, but encounters difficulties when the container body is plastic or composite because of the relative lack of ductility and lack of permanent deformability of such materials.

BRIEF SUMMARY OF THE DISCLOSURE

The present disclosure relates to an alternative to the traditional double-seaming approach for attaching metal ends to containers. The metal end and the method described herein for affixing the metal end to a container body are suitable for container bodies of various materials including metal, plastic, and composite paperboard/plastic or paperboard/foil/plastic materials.

In accordance with one embodiment, a container assembly comprises a container body formed by a side wall having an upper edge, and a top metal end for affixing to the upper edge of the side wall. The metal end is formed of a shaped metal sheet that has a peripheral edge. The sheet is shaped prior to being applied to the container body such that the outer peripheral region of the sheet includes an inner chuck wall that extends upwardly to a top rim of the metal end, the top rim comprising an outwardly curled, downwardly facing upper U-shaped section. The outer peripheral region of the metal sheet is further shaped to include a skirt extending downwardly from the top rim, a lower end portion of the skirt being formed as an inwardly curled, upwardly facing lower U-shaped section, and an outer chuck wall extending upwardly from the lower U-shaped section, the peripheral edge of the metal sheet defining a top edge of the outer chuck wall. The outer chuck wall is radially spaced from the inner chuck wall so as to define an annular channel therebetween configured to allow the top metal end to be pushed onto the upper edge of the side wall such that the upper edge is received into the annular channel. A heat-sealable material is disposed on at least one of the opposing surfaces of the inner and outer chuck walls.

The metal end is sealed to the container body not by a purely mechanical locking together of the metal end and container body as in conventional double-seaming, but instead by thermal fusion of the heat-sealable material provided on the inner and/or outer surfaces of the side wall and on the opposing surfaces of the inner and/or outer chuck walls. Indeed, the step of pushing the metal end onto the container body to insert the upper edge of the side wall into the annular channel does not require or involve any significant deformation of the metal end or of the container body side wall. Consequently, the material of the container body and its mechanical properties are not of particular importance to the proper attachment of the metal end, and hence the approach is suitable for container bodies of virtually any material as long as a heat-sealable material can bond to the container body with sufficient strength.

Metal ends can be affixed in this manner to both top and bottom ends of a generally tubular container body (for example, a composite paperboard/plastic or paperboard/foil/plastic can), if desired. The approach is also useful for container bodies such as blow-molded plastic cans that require only a single metal end for closing the top opening.

The metal ends can be formed to allow containers to be stacked.

The heat-sealing of the metal end onto the container body can be accomplished in various ways, including but not limited to induction heating of the metal end to melt and fuse the heat-sealable materials together.

BRIEF DESCRIPTION OF THE SEVERAL VIEWS OF THE DRAWING(S)

Having thus described the disclosure in general terms, reference will now be made to the accompanying drawings, which are not necessarily drawn to scale, and wherein:

Figure 2:
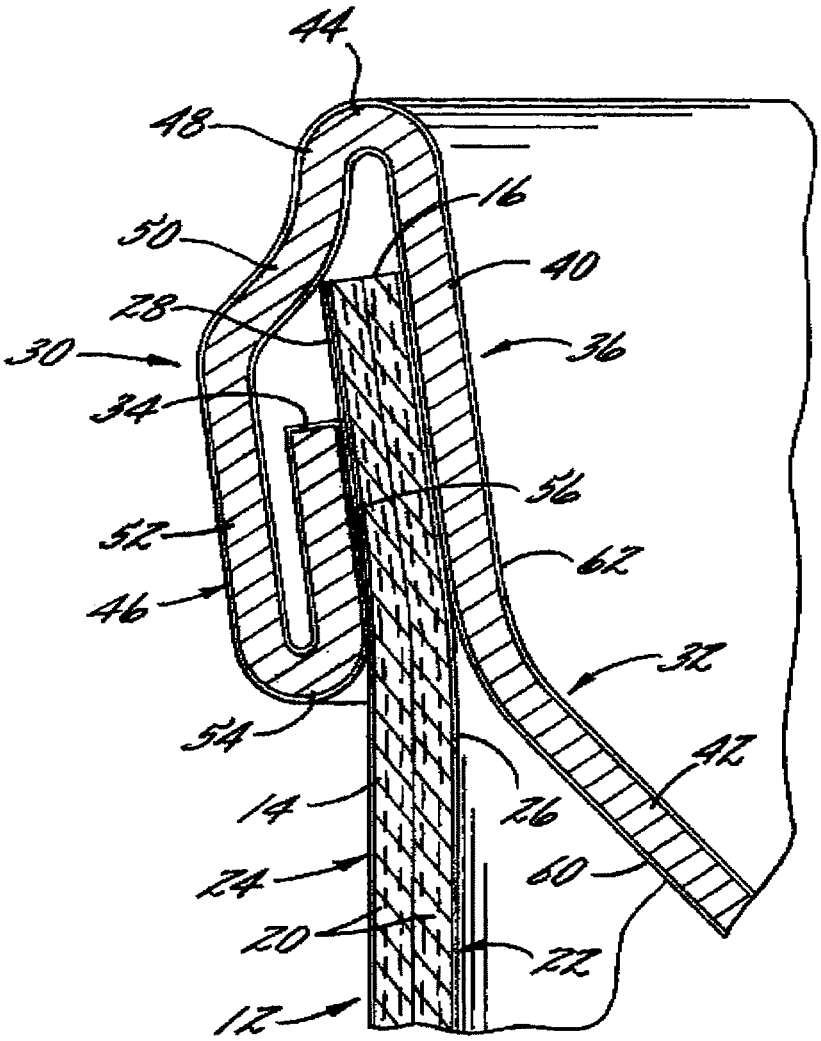
FIG. 2 is a view similar to FIG. 1, showing the metal end after it has been pushed onto the side wall of the container body.
Figure 3:
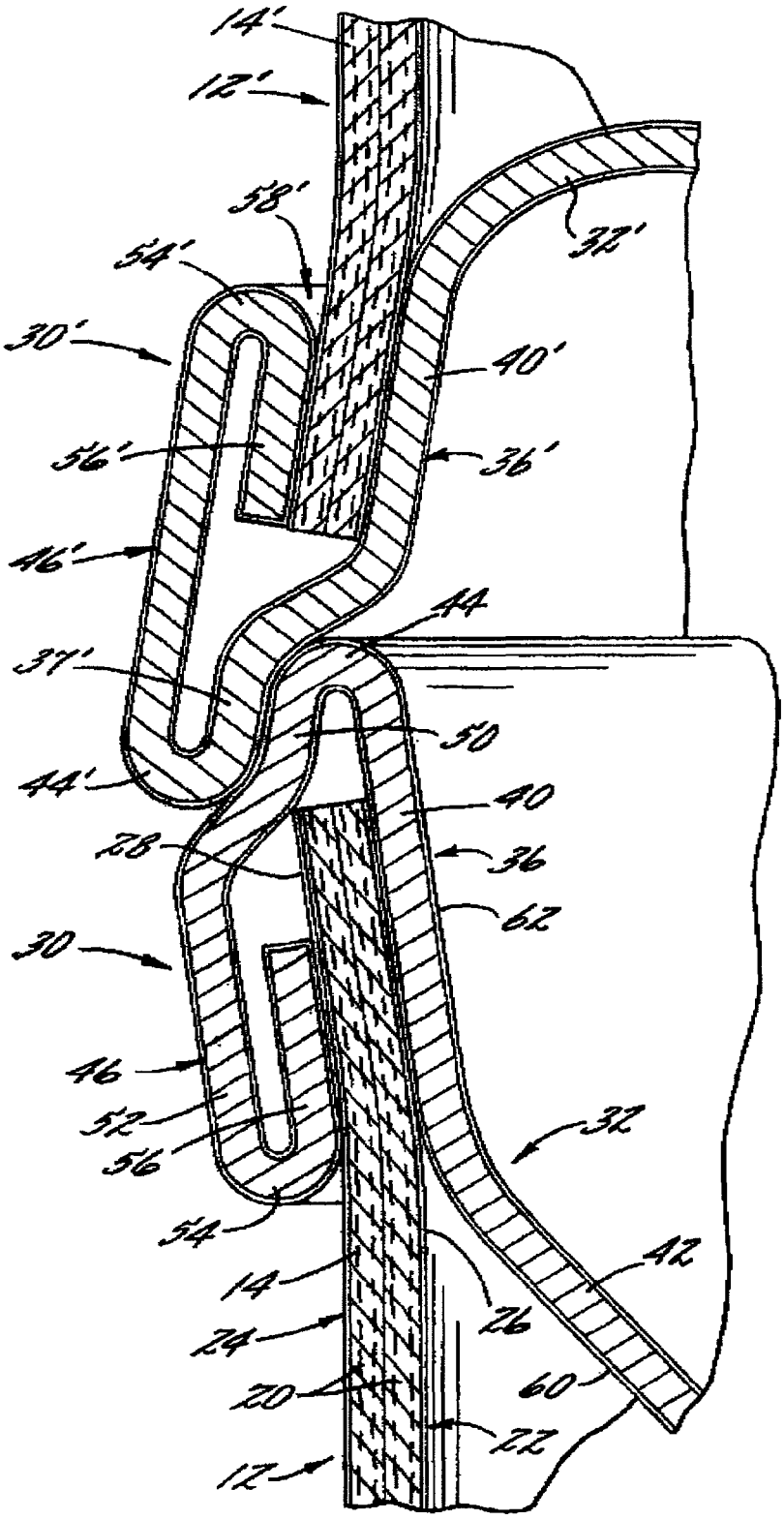
Figure 4:
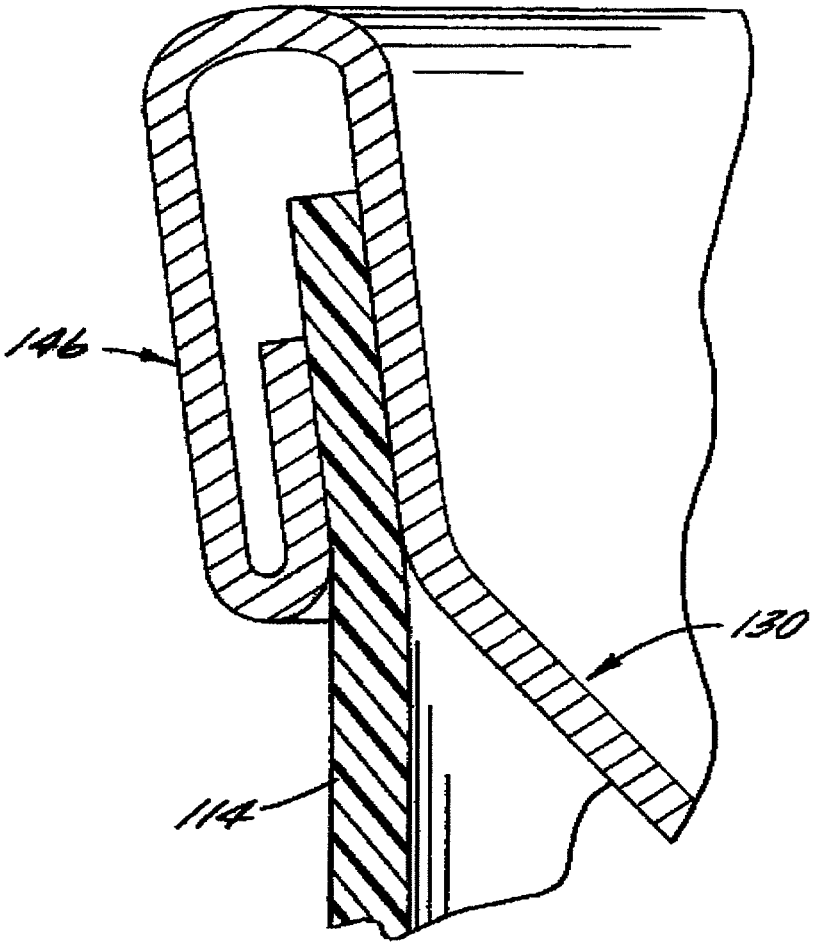

FIG. 3 a view similar to FIG. 2, showing a bottom of a second container stacked atop the metal end of the first container; and FIG. 4 is a view similar to FIG. 2, showing another embodiment of the invention.

DETAILED DESCRIPTION OF THE DRAWINGS

The present invention now will be described more fully hereinafter with reference to the accompanying drawings in which some but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

Figure 1:
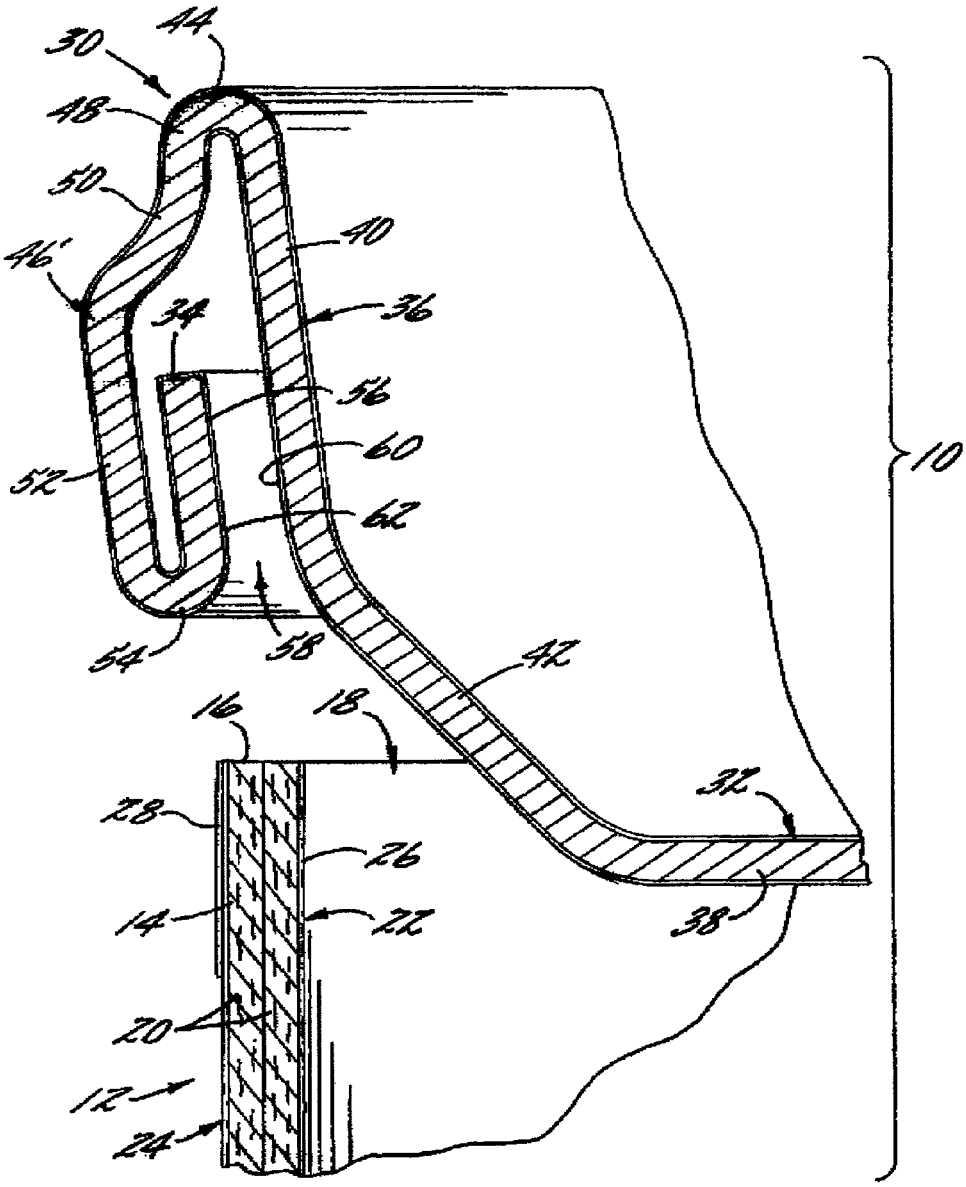
FIG. 1 is a fragmentary cross-sectional view of a container assembly in accordance with one embodiment of the invention, showing a metal end prior to being applied onto the upper edge of the container body side wall.

A container assembly 10 in accordance with a first embodiment of the invention is shown in FIG. 1. The container assembly comprises a container body 12 and a metal end 30. The container body 12 can comprise any of various configurations and materials. Generally, the container body will include a side wall 14 that encircles an axis. The side wall 14 has an upper edge 16 that circumscribes a top opening 18 of the container body. The side wall can define a cross-sectional shape for the container body that is round, oval, oblong, rectangular, square, triangular, or any other desired shape, and thus the top opening 18 can have any of such shapes. In the specification and claims of the present application, references to the "radial" direction are not meant to suggest or require that the container body has a round cross-sectional shape, but rather refer more generally to the direction perpendicular to the axis about which the side wall 14 extends, and thus apply to any cross-sectional shape for the container body.

The side wall 14 can be formed of various materials, including metal, plastic, or composite materials. By "composite" material is meant a multi-ply structure formed as a laminate of two or more layers of different materials, typically including at least one paperboard layer and at least one additional layer that can comprise metal foil such as aluminum foil or a plastic layer such as plastic film or a polymer coating. Often, composite containers include paperboard, foil, and plastic layers. For example, a typical composite container as illustrated in FIG. 1 has a side wall 14 of paperboard plies 20 adhesively laminated together to provide structural strength to the container body, and an impervious liner 22 adhered to the radially inner surface of the wall formed by the paperboard plies for rendering the side wall 14 substantially impervious to liquids and gases. The liner 22 typically includes a barrier layer such as metal foil or polymer film (e.g., metallized polyester, EVOH, $SiO_x$-coated polyester, $AlO_x$-coated polyester, or the like). The particular structure of the liner is not critical to the present invention. The composite side wall typically also includes an outer label ply 24 adhered to the radially outer surface of the wall formed by the paperboard plies. The label ply can comprise a thin paper layer (e.g., thin kraft), a plastic film layer, or the like.

The radially innermost surface of the side wall 14 has a layer 26 of heat-sealable material covering at least the part of the side wall adjacent the upper edge 16. In the embodiment shown in FIG. 1, the heat-sealable layer 26 covers the entire inner surface of the side wall, but alternatively the heat-sealable layer could be localized to the region adjacent the upper edge 16. The heat-sealable layer 26 can comprise a layer of the liner 22 that is employed for sealing edges of the liner together to form a joint or seam for the liner. Alternatively, the heat-sealable layer 26 can comprise a coating provided specifically for purposes of attaching the metal end 30 to the side wall as described below.

The radially outermost surface of the side wall 14 likewise has a layer 28 of heat-sealable material covering at least the part of the side wall adjacent the upper edge 16. The heat-sealable layer 28 can be localized to the region adjacent the upper edge 16 or can cover the entire outer surface of the side wall (e.g., the layer 28 could be an outer layer of the label ply 24 provided for sealing edges of the label ply together to form a joint or seam for the label). A localized heat-sealable layer 28 is shown in FIG. 1.

When the side wall 14 is not a composite material as described above, the heat-sealable materials 26, 28 nevertheless are provided on the inner and outer surfaces at least adjacent the upper edge 16. For example, if the side wall is metal, then a coating of heat-sealable material can be provided on each of the inner and outer surfaces. The coating on the inner surface can serve to protect the container contents from direct contact with the metal. If the side wall is plastic (e.g., when the container body is a blow-molded plastic container), the side wall material itself can comprise a heat-sealable material such as polypropylene or polyethylene.

The metal end 30 is formed of a blank of metal sheet 32. The metal sheet can have a thickness ranging from about 0.0055" to about 0.0110". The sheet is stamped or cut out to have a plan shape generally corresponding to the cross-sectional shape of the container body side wall at the upper edge 16. Thus, if the upper edge 16 has a circular shape then the blank is circular, if the upper edge is rectangular then the blank is rectangular, etc. The metal sheet 32 has an outer peripheral edge 34. The region of the metal sheet adjacent the outer edge 34 is deformed by suitable tool and die operations to have a configuration enabling the metal end 30 to be affixed to the side wall 14 in a manner described below.

More particularly, the outer peripheral region of the metal sheet 32 is shaped to be annular (i.e., to encircle the central axis about which the side wall 14 extends, and to have a substantially uniform cross-sectional shape about the annulus). The annular shape of this peripheral region substantially matches that of the side wall 14 of the container body at the upper edge 16. The peripheral region of the metal end 30 is shaped to include an inner chuck wall 36 that extends generally upwardly from the main central panel 38 of the metal end. The inner chuck wall can include a substantially linear upper portion 40 that is relatively closer to vertical (i.e., closer to being parallel to the central axis) but that can be somewhat inclined relative to vertical as shown in FIG. 1, and a substantially linear lower portion 42 that is connected to the lower end of the upper portion 40 and that is relatively farther from vertical. The lower radially inner end of the lower portion 42 joins with the central panel 38. The upper end of the upper portion 40 of the inner chuck wall joins with a top rim 44 of the metal end. The top rim 44 is shaped as a generally U-shaped section that faces downwardly (i.e., the open end of the "U" faces generally downwardly).

The outer peripheral region of the metal sheet 32 is further shaped to include a skirt 46 that depends from the top rim 44 and that extends downwardly approximately parallel to the upper portion 40 of the inner chuck wall 36 and is spaced radially outwardly therefrom. The skirt in the embodiment of FIG. 1 includes a first (uppermost) portion 48 located just below the top rim 44, a second (middle) portion 50 located below the first portion 48, and a third (lowermost) portion 52 located below the second portion 50. The second portion 50 is oriented closer to horizontal than the first and third portions 48, 52 and forms a stacking surface on which a bottom of another container can be stacked, as further described below in connection with FIG. 3.

The lowermost or third portion 52 of the skirt joins with a lower generally U-shaped section 54 that faces generally upwardly. An outer chuck wall 56 extends upwardly from the lower U-shaped section 54 and is spaced from the inner chuck wall 36 (and specifically the upper portion 40 thereof). The lower end of the outer chuck wall 56 is at approximately the same vertical level as the lower end of the inner chuck wall portion 40 where the metal sheet bends to extend radially inwardly and downwardly along the lower portion 42 of the inner chuck wall. The outer chuck wall terminates at an upper edge defined by the edge 34 of the metal sheet that forms the metal end. The upper edge of the outer chuck wall is spaced below the second portion 50 of the skirt 46 in the illustrated embodiment, although it is possible for the upper edge of the outer chuck wall to contact the lower surface of the skirt if desired.

An annular channel 58 is defined between the inner and outer chuck walls. The channel 58 has an annular shape generally matching that of the upper edge 16 of the side wall 14 of the container body. The channel 58 has a radial width selected with regard to the thickness of the side wall at the upper edge 16 such that the side wall can be inserted into the channel with a close fit as shown in FIG. 2.

A layer of heat-sealable material 60 is disposed on at least the portion of the outer surface of the inner chuck wall 36 that contacts the inner heat-sealable material 26 on the inner surface of the container body side wall 14. If desired, the heat-sealable layer 60 can cover the entire lower surface of the metal end as shown, which is advantageous for preventing the contents of the container from directly contacting the metal; alternatively, the heat-sealable layer 60 could be localized to the portion of the inner chuck wall's outer surface that contacts the container body side wall, and another coating (e.g., lacquer) could be employed for protecting against metal contact.

At least the portion of the inner surface of the outer chuck wall 56 that contacts the side wall 14 has a layer of heat-sealable material 62 disposed thereon. If desired, the heat-sealable layer 62 can cover the entire upper surface of the metal end as shown.

Once the metal end 30 is pushed onto the container body side wall 14 to insert the side wall into the channel 58 as shown in FIG. 2, the outer peripheral region of the metal end 30 is heated by a suitable method (e.g., induction heating) so as to cause the heat-sealable layers 26 and 60 to melt and fuse together and to cause the heat-sealable layers 28 and 62 to melt and fuse together. Upon cooling, the re-solidified heat-sealable material bonds the metal end to the container body side wall in a secure and hermetic fashion. The process of applying the metal end 30 onto the container body and sealing the metal end thereon thus entails no significant deformation of the container body side wall 14 (and particularly no outward rolling or curling of the side wall as required with conventional double-seaming), and no significant deformation of the metal end 30. The metal end is simply pushed straight onto the side wall, and heating then seals the end onto the container body.

The heat-sealable layers 26, 28, 60, 62 can comprise any of various heat-sealable materials, including but not limited to polyethylene, polypropylene, ionomers such as SURLYN® (ethylene acrylic acid copolymer having acid groups partially neutralized with sodium ions), and the like. The heat-sealable material on the metal end 30 can be, but need not be, identical to the heat-sealable material on the container body side wall 14, the important consideration being that if different heat-sealable materials are employed, the melting point temperatures of the materials should not be too greatly different.

The present invention is subject to numerous variations and embodiments. In the embodiment of FIGS. 1 and 2, as noted, the metal end 30 defines a stacking surface 50 on the outer skirt 46. In accordance with this embodiment, a second container having a bottom metal end 30' can be stacked atop the top metal end 30 of the first container. In particular, the second container can have a bottom metal end 30' that is formed generally similarly to the metal end 30 described above. However, unlike the metal end 30, the bottom metal end 30' of the second container has its stacking feature defined by the inner chuck wall 36' rather than by the skirt. More particularly, the metal end 30' has a bottom rim 44' formed as an upwardly facing U-shaped section from which the inner chuck wall 36' extends upwardly. The inner chuck wall has a first portion 37' just above the bottom rim 44', a second portion 39' above the first portion, and a third portion 40' above the second portion. The second portion 39' is closer to being horizontal than the first and third portions and defines a stacking surface for engaging the top rim 44 of the metal end of the underlying container. The bottom rim 44' has a minimum inside diameter, an outside diameter of the first portion 48 of the outer skirt 46 of the top metal end 30 is less than said minimum inside diameter of the bottom rim 44', and an outside diameter of the third portion 52 of the skirt 46 is greater than said minimum inside diameter.

The bottom metal end 30' also has an outer skirt 46' that extends upwardly from the bottom rim 44' to an upper U-shaped section 54' that faces downwardly, and an outer chuck wall 56' extends downwardly from the upper U-shaped section and is spaced from the inner chuck wall portion 40'. An annular channel 58' is defined between the chuck walls 40' and 56' for receiving the side wall 14' of the second container body, the metal end 30' being heat-sealed onto the side wall in the manner previously described.

It will be recognized that the embodiment having a top metal end 30 and a bottom metal end 30' as shown in FIG. 3 can be reversed such that the metal end 30 (or one having a similar configuration in which the stacking feature is defined by the skirt) is used on the bottom end of the container and the metal end 30' (or one having a similar configuration in which the stacking feature is defined by the inner chuck wall) is used on the top end of the container.

It is also possible to configure the metal end such that there is no stacking feature. Such an embodiment is shown in FIG. 4. The metal end 130 of this embodiment is generally similar to the metal end 30 previously described, except that the skirt 146 does not have a stacking feature. Additionally, the container body side wall 114 in the embodiment of FIG. 4 is formed of a plastic material rather than a composite material. The plastic material can comprise a thermoplastic material that is heat-sealable to the heat-sealable layers on the chuck walls of the metal end.

In the embodiments described above, the metal sheet is shaped into its ultimate form prior to being applied to the container body. Thus, the metal end has the skirt, lower U-shaped section, and outer chuck wall already formed in their ultimate configurations before the metal end is pushed onto the container body. Application of the metal end to the container body does not require any specialized tooling for making a double seam, and the difficulties of forming a double seam are avoided.

The embodiments described above and illustrated in the drawings have heat-sealable material layers 26 and 28 on both the inner and outer surfaces of the container body side wall 14, and correspondingly both chuck walls 36, 56 have heat-sealable layers 60, 62 thereon such that two heat seals are formed. However, it is within the scope of the invention to omit one of the heat seals. For example, the heat-sealable layers 26 and 60 can be omitted, such that only one heat seal is formed between the layers 28 and 62 on the outer surface of the container body side wall and the outer chuck wall. Alternatively, the heat-sealable layers 28 and 62 can be omitted, such that only one heat seal is formed between the layers 26 and 60 on the inner surface of the container body side wall and the inner chuck wall.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A container assembly comprising:

a container body including a side wall that defines an upper edge circumscribing a top opening of the container body, a heat-sealable material being disposed on a radially inner surface of the side wall and on a radially outer surface of the side wall adjacent the upper edge; and a top metal end for being affixed to the upper edge of the side wall to seal closed the top opening, the top metal end comprising a metal sheet having a peripheral edge, the sheet prior to a first application of the top metal end to any container body having an outer peripheral region of the sheet that includes:

an outwardly angled inner chuck wall that includes a substantially linear upper portion that extends upwardly to a top rim of the metal end, the top rim comprising an outwardly curled, downwardly facing upper U-shaped section;

a skirt extending downwardly from the top rim, a lower end portion of the skirt being formed as an inwardly curled, upwardly facing lower U-shaped section;

an outwardly angled substantially linear outer chuck wall extending upwardly from the lower U-shaped section, the peripheral edge of the metal sheet defining a top edge of the outer chuck wall, wherein the outer chuck wall is spaced from the inner chuck wall and is approximately parallel to the upper portion thereof so as to define an annular channel therebetween configured to allow the top metal end to be pushed onto the upper edge of the side wall such that the upper edge is received into the annular channel; and heat-sealable material disposed on each of opposing surfaces of the inner and outer chuck walls prior to said first application of the top metal end to any container body;

whereby the top metal end is adapted to be affixed to the container body by thermal fusion of the heat-sealable materials provided on said inner and outer surfaces of the side wall and on said opposing surfaces of the inner and outer chuck walls.

2. The container assembly of claim 1, wherein the skirt of the top metal end comprises a first portion disposed just below the top rim, a second portion disposed below the first portion, and a third portion disposed below the second portion, and wherein the second portion of the skirt is oriented closer to horizontal than the first and third portions.

3. The container assembly of claim 2, wherein the container has a bottom end defining a bottom rim that extends below an upwardly recessed bottom panel of the bottom end, the bottom rim having a minimum inside diameter, wherein an outside diameter of the first portion of the skirt is less than said minimum inside diameter of the bottom rim, and an outside diameter of the third portion of the skirt is greater than said minimum inside diameter.

4. The container assembly of claim 1, wherein the container body has a lower edge circumscribing an opening at a bottom of the container body, a heat-sealable material being disposed on at least one of radially inner and outer surfaces of the side wall adjacent the lower edge, the container assembly further comprising a bottom metal end for being affixed to the lower edge of the side wall to seal closed the bottom opening, the bottom metal end comprising a second metal sheet having a peripheral edge, the second sheet having a shape prior to a first application of the bottom metal end to any container body such that an outer peripheral region of the second sheet includes:

an inner chuck wall that extends downwardly to a bottom rim of the bottom metal end, the bottom rim comprising an outwardly curled, upwardly facing lower U-shaped section;

a skirt extending upwardly from the bottom rim and having an upper end portion formed as an inwardly curled, downwardly facing upper U-shaped section;

an outer chuck wall extending downwardly from the inwardly curled, downwardly facing upper U-shaped section, the peripheral edge of the second metal sheet defining a bottom edge of the outer chuck wall of the bottom metal end, wherein the outer chuck wall of the bottom metal end is spaced from the inner chuck wall of the bottom metal end so as to define an annular channel therebetween configured to allow the bottom metal end to be pushed onto the lower edge of the side wall such that the lower edge is received into the annular channel of the bottom metal end; and heat-sealable material disposed on at least one of opposing surfaces of the inner and outer chuck walls of the bottom metal end;

whereby the bottom metal end is adapted to be affixed to the container body by thermal fusion of the heat-sealable material provided on said at least one of the inner and outer surfaces of the side wall and on said at least one of the opposing surfaces of the inner and outer chuck walls of the bottom metal end.

5. The container assembly of claim 4, wherein the top and bottom metal ends define complementary stacking features such that the bottom metal end of the container can be stacked atop a top metal end of an identical container.

6. The container assembly of claim 5, wherein the stacking features include a stacking surface defined by the inner chuck wall of one of the top and bottom metal ends.

7. The container assembly of claim 5, wherein the stacking features include a stacking surface defined by the skirt of one of the top and bottom metal ends.

8. A metal end for application to a container body having an edge circumscribing an opening of the container body, the metal end comprising a metal sheet having a peripheral edge, the sheet prior to a first application of the metal end to any container body having an outer peripheral region of the sheet that includes:

an outwardly angled inner chuck wall that includes a substantially linear upper portion that extends upwardly to a top rim of the metal end, the top rim comprising an outwardly curled, downwardly facing upper U-shaped section;

a skirt extending downwardly from the top rim, a lower end portion of the skirt being formed as an inwardly curled, upwardly facing lower U-shaped section;

an outwardly angled substantially linear outer chuck wall extending upwardly from the lower U-shaped section, the peripheral edge of the metal sheet defining a top edge of the outer chuck wall, wherein the outer chuck wall is spaced from the inner chuck wall and is approximately parallel to the upper portion thereof so as to define an annular channel therebetween configured to allow the metal end to be pushed onto the upper edge of the side wall such that the upper edge is received into the annular channel; and heat-sealable material disposed on each of opposing surfaces of the inner and outer chuck walls prior to said first application of the metal end to any container body.

9. The metal end of claim 8, wherein both of the opposing surfaces of the inner and outer chuck walls have the heat-sealable material thereon.

10. The metal end of claim 8, wherein the inner chuck wall extends downwardly to a lower end of the inner chuck wall at which the metal end bends to extend radially inwardly and downwardly.

11. The metal end of claim 10, wherein the lower end of the inner chuck wall and the lower end of the outer chuck wall are at the same vertical level.

12. A method for sealing closed an opening in a container body, the container body having a side wall defining an upper edge circumscribing the opening, the method comprising the steps of:

(a) providing a heat-sealable material disposed on radially inner and outer surfaces of the side wall adjacent the upper edge;

(b) providing a metal end comprising a metal sheet having a peripheral edge, the sheet prior to a first application of the metal end to any container body having an outer peripheral region of the sheet that includes:

an outwardly angled inner chuck wall that includes a substantially linear upper portion that extends upwardly to a top rim of the metal end, the top rim comprising an outwardly curled, downwardly facing upper U-shaped section;

a skirt extending downwardly from the top rim, a lower end portion of the skirt being formed as an inwardly curled, upwardly facing lower U-shaped section;

an outwardly angled substantially linear outer chuck wall extending upwardly from the lower U-shaped section, the peripheral edge of the metal sheet defining a top edge of the outer chuck wall, wherein the outer chuck wall is spaced from the inner chuck wall and is approximately parallel to the upper portion thereof so as to define an annular channel therebetween configured to allow the metal end to be pushed onto the upper edge of the side wall such that the upper edge is received into the annular channel; and heat-sealable material disposed on each of opposing surfaces of the inner and outer chuck walls prior to said first application of the metal end to any container body;

(c) pushing the metal end onto the container body such that the upper edge of the container body side wall is received in the annular channel of the metal end; and (d) causing the heat-sealable material on the side wall and the inner and outer chuck walls to melt and fuse together so as to seal the metal end to the container body.

13. The method of claim 12, wherein step (c) is carried out without requiring deformation of the metal end.

14. The method of claim 12, wherein step (c) is carried out without any rolling of the upper edge of the container body side wall.

15. The method of claim 12, wherein step (d) comprises induction heating the metal end.

* * * * *